US010681999B2

(12) United States Patent
Wagner

(10) Patent No.: US 10,681,999 B2
(45) **Date of Patent: *Jun. 16, 2020**

(54) EXPANDABLE AND COLLAPSIBLE PILLOW STRUCTURE

(71) Applicant: PILLOWVISION, LLC, San Marino, CA (US)

(72) Inventor: John Jay Wagner, New Canaan, CT (US)

(73) Assignee: PILLOWVISION, LLC, San Marino, CA (US)

( * ) Notice: Subject to any disclaimer, the term of this patent is extended or adjusted under 35 U.S.C. 154(b) by 16 days.

This patent is subject to a terminal disclaimer.

(21) Appl. No.: 16/126,423

(22) Filed: Sep. 10, 2018

(65) Prior Publication Data

US 2019/0282007 A1 Sep. 19, 2019

Related U.S. Application Data

(60) Continuation of application No. 15/531,203, filed as application No. PCT/US2015/062529 on Nov. 24, 2015, now Pat. No. 10,098,486, application No. 16/126,423, which is a continuation-in-part of application No. 15/816,962, filed on Nov. 17, 2017, now Pat. No. 10,159,365, which is a continuation of application No. 15/295,680, filed on Oct. 17, 2016, (Continued)

(51) Int. Cl.

| | |
|---|---|
| ***A47G 9/10*** | (2006.01) |
| ***A47C 7/38*** | (2006.01) |
| ***A47C 16/00*** | (2006.01) |

(52) U.S. Cl.

CPC ..... *A47G 9/1063* (2013.01); *A47C 7/383* (2013.01); *A47C 16/00* (2013.01); *A47G 9/1027* (2013.01)

(58) Field of Classification Search

CPC ... A47C 20/027; A47C 27/146; A47C 20/026; A47C 16/00; A47G 9/10; A47G 9/062; A47G 9/1063; A47G 2009/1018

See application file for complete search history.

(56) References Cited

U.S. PATENT DOCUMENTS

| | | | |
|---|---|---|---|
| 2,107,962 | A | 2/1938 | Sheasby |
| 2,551,727 | A | 5/1951 | Costello |

(Continued)

FOREIGN PATENT DOCUMENTS

| | | | |
|---|---|---|---|
| CN | 2436037 | Y | 6/2001 |
| CN | 201067259 | Y | 6/2008 |

(Continued)

OTHER PUBLICATIONS

International Searching Authority, International Search Report and Written Opinion for International Application No. PCT/US2015/062529, dated Feb. 4, 2016, 8 pages.

*Primary Examiner* — Eric J Kurilla

(74) *Attorney, Agent, or Firm* — Gordon Rees Scully Mansukhani LLP; Kathryn K. Hull

(57) ABSTRACT

A supporting pillow structure for a user to sleep or to perform sedentary activity facing down toward the pillow structure with the user's hands and arms placed below their face. Embodiments of the pillow structure may be configured to provide users with comfort and support while the user is seated leaning forward at a desk or table. Embodiments may be further configured to expand and compress, for example to inflate and deflate, into a compact easy to carry package.

20 Claims, 12 Drawing Sheets

Related U.S. Application Data now Pat. No. 9,839,309, which is a continuation of application No. 14/819,641, filed on Aug. 6, 2015, now Pat. No. 9,468,319, which is a division of application No. 13/902,741, filed on May 24, 2013, now Pat. No. 9,131,792.

(60) Provisional application No. 62/085,305, filed on Nov. 27, 2014.

(56) References Cited

U.S. PATENT DOCUMENTS

| | | | |
|---|---|---|---|
| 2,688,142 | A | 9/1954 | Jensen |
| 3,009,172 | A | 9/1961 | Eidam |
| 3,251,075 | A | 5/1966 | Saltness, Jr. et al. |
| 3,366,106 | A | 1/1968 | Yao et al. |
| 3,533,113 | A | 10/1970 | Stamberger |
| 3,606,623 | A | 9/1971 | Aymar |
| 3,883,906 | A | 5/1975 | Sumpter |
| 3,897,102 | A | 7/1975 | Lemaire |
| D271,834 | S | 12/1983 | Huntsinger |
| D277,059 | S | 1/1985 | Boone |
| 4,821,355 | A | 4/1989 | Burkhardt |
| D309,542 | S | 7/1990 | Glenn |
| 5,127,120 | A | 7/1992 | Mason |
| D337,914 | S | 8/1993 | McDonald |
| 5,269,035 | A | 12/1993 | Hartunian |
| 5,345,630 | A | 9/1994 | Healy |
| 5,369,824 | A | 12/1994 | Powell |
| 5,400,449 | A | 3/1995 | Satto |
| D364,464 | S | 11/1995 | Gigante |
| 5,479,667 | A | 1/1996 | Nelson |
| 5,632,050 | A | 5/1997 | Zajas et al. |
| 5,644,809 | A | 7/1997 | Olson |
| 5,652,981 | A | 8/1997 | Singer-Leyton et al. |
| 5,699,569 | A | 12/1997 | Schwarz-Zohrer |
| 5,865,181 | A | 2/1999 | Spence, Jr. |
| 5,893,183 | A | 4/1999 | Bechtold, Jr. |
| D414,974 | S | 10/1999 | Marrone, II et al. |
| 5,960,494 | A | 10/1999 | Gilliland et al. |
| 6,128,797 | A | 10/2000 | Shaffer |
| 6,142,844 | A | 11/2000 | Klauber |
| 6,151,734 | A | 11/2000 | Lawrie |
| 6,317,909 | B1 | 11/2001 | Blum |
| D471,050 | S | 3/2003 | Haubner |
| 6,671,907 | B1 | 1/2004 | Zuberi |
| 6,842,924 | B1 | 1/2005 | Walters |
| 6,857,149 | B2 | 2/2005 | Hoggatt et al. |
| 6,902,537 | B1 | 6/2005 | Geisert |
| 7,020,918 | B1 | 4/2006 | Tinsley |
| D578,220 | S | 10/2008 | Ebarb |
| D585,139 | S | 1/2009 | Andrews |
| 7,621,005 | B1 | 11/2009 | Harvey |
| 7,788,751 | B1 | 9/2010 | Diemer et al. |
| 7,997,276 | B2 | 8/2011 | Goff |
| 8,006,335 | B1 | 8/2011 | Andermann |
| 8,069,515 | B1 | 12/2011 | Tingey |
| D686,026 | S | 7/2013 | Wagner |
| 8,549,683 | B2 | 10/2013 | Ratner |
| D715,580 | S | 10/2014 | Ganjavian et al. |
| D718,074 | S | 11/2014 | Savolainen |
| 2002/0184706 | A1 | 12/2002 | Riach |
| 2003/0172462 | A1 | 9/2003 | Hoggatt et al. |
| 2004/0064893 | A1 | 4/2004 | Sharp |
| 2004/0111801 | A1 | 6/2004 | Marin et al. |
| 2005/0177946 | A1 | 8/2005 | Riley |
| 2008/0303318 | A1 | 12/2008 | Hamilton |
| 2009/0144904 | A1 | 6/2009 | Moye |
| 2009/0302659 | A1 | 12/2009 | Goddu |
| 2010/0242179 | A1 | 9/2010 | Berke |
| 2010/0300455 | A1 | 12/2010 | Goff |
| 2011/0296615 | A1 | 12/2011 | Tingey |
| 2013/0276236 | A1 | 10/2013 | Rasmussen |

FOREIGN PATENT DOCUMENTS

| | | | |
|---|---|---|---|
| CN | 102462284 | A | 5/2012 |
| CN | 105640182 | A | 6/2016 |

EXPANDABLE AND COLLAPSIBLE PILLOW STRUCTURE

CROSS REFERENCE TO RELATED APPLICATIONS

This application is a continuation of U.S. application Ser. No. 15/531,203, filed on May 26, 2017, which is a national phase application of PCT/US15/062529, filed on Nov. 24, 2015, which claims priority to U.S. provisional application No. 62/085,305, filed on Nov. 27, 2014. This application also is a continuation in part of U.S. application Ser. No. 15/816,962, filed on Nov. 17, 2017, which is a continuation of U.S. application Ser. No. 15/295,680, filed Oct. 17, 2016 and now U.S. Pat. No. 9,839,309, issued Dec. 12, 2017, which is a continuation of Ser. No. 14/819,641, filed Aug. 6, 2015 and now U.S. Pat. No. 9,468,319, issued Oct. 18, 2016, which is a divisional of U.S. application Ser. No. 13/902,741, filed May 24, 2013 and now U.S. Pat. No. 9,131,792, issued Sep. 15, 2015. The entire contents of all related applications are incorporated by reference in their entirety herein.

TECHNICAL FIELD

This disclosure relates in general to pillows and more specifically to a collapsible pillow structure having a cavity in the pillow structure and openings from the outside of the structure to the cavity so that users can rest face-down on the structure and place their hands and arms into the structure and be able to view an item placed into a cavity in the middle of the pillow structure through the opening for their face.

BACKGROUND

There are many bedding products, including mattresses and pillows designed to increase a user's comfort while lying down to sleep or rest or perform sedentary activities. Some major concerns for people lying down or sleeping are related to breathing, pressure, stress, alignment, and overall comfort. These concerns can be greater for overweight users, athletic users, and pregnant women.

Most pillows are designed to provide support for the user's head and neck while the user lays down on their back or side. Some designs are created to keep the user's spine in alignment while the user sleeps on their side or back. These pillows may be designed with curves upward to provide further support in the area at the base of the skull for the user sleeping on their back or at the neck and jawline of the user sleeping on their side. Some pillows are manufactured out of special materials to provide support or flexibility and to contour to the user's unique shape. However, not all people prefer to lie down or sleep on their back or side, and the above mentioned specially designed pillows are not comfortable for a user who chooses to sleep on their front facing the pillow.

Some people prefer to sleep or rest face-down to increase their comfort and alleviate their concern with breathing, loss of circulation, and pressure. For example, some people sleep face down because they are uncomfortable sleeping on their back due to breathing problems, such as a closing of their airway or sleep apnea. Some people sleep face down because they find that sleeping on their side will cause their arms to fall asleep or their spine to feel mis-aligned. Many people toss and turn throughout the night trying to get comfortable or reposition their body to relieve some stress on their arms, hips, neck, head, and back.

Sleeping face-down on a standard pillow can cause issues with airflow, breathing, and temperature control. Sleeping facing down can also cause problems with blood circulation in the arms if the arms are pressed under the body. It can also cause breathing problems or issues with air flow or circulation when the user is facing the pillow. Further, issues with temperature control can be caused by breathing into a pillow pressed against the user's face. Some users turn their head sideways when sleeping face-down to increase airflow and temperature control. This can cause a strain on the user's neck, arms, and back if the user turns their head to sleep with their current pillows.

Pillows have been designed to help provide a place for an adult's face to lay, or a hole, which allows room for the user to breathe, for example U.S. Design Patent No. D277,059 (Boone).

Some users take stress off their neck when they sleep on their front by placing their arms or hands under the pillow to prop the pillow up to. This can cause a loss of blood circulation to the arms or hands with their arm placed under the pressure of the body, head, or pillow. One attempt to solve this problem of creating space under a pillow is U.S. Pat. No. 3,883,906 (Sumpter), which provides tunnel-like openings for the arms of a sleeper. Sumpter provides that the user's arms would be extended above the user's head and parallel to their body underneath the pillow.

The problems described above also occur when the user tries to perform sedentary tasks when resting on their front facing a pillow structure. For example, users seek a comfortable way to perform sedentary tasks, such as reading email or typing on an electronic device, reading books, or performing tasks on their mobile devices, cell phones, or tablets while resting. These tasks can include many different tasks on various devices or objects, such as reading and writing emails and text messages; watching videos, such as sports, movies and television shows; surfing the internet; reading the news and gossip; shopping online; and other tasks requiring limited ability to move. With the proliferation of smaller devices capable of performing these tasks and other tasks, people are more likely to perform these tasks on a smaller device and at various locations. Although these tasks may take place while the user is seated, such as at a desk, on an airplane, or at a table, these tasks may alternately take place while the user is leaning forward while seated or while the user is lying down. Many people perform these tasks in bed. Some people are not comfortable lying on their back while holding a book or mobile device, cell phone, or tablet above them for an extended period of time. Holding an object above your face for an extended period of time can be uncomfortable. Some people are not comfortable lying on their side for an extended period of time holding a book or device. Lying on one's side limits the ability of one arm or hand to hold the book and turn the page or to touch the device. Further, many new devices contain technology that automatically turns the image on the device based on how the device is oriented, assuming the user is not lying sideways, so that a user reading a website or looking at a picture or video with their head turned sideways must awkwardly turn (or change the settings on their device).

Another problem people have while lying down is comfortably listening to audio through headphones. Some people listen to music, books "on tape," audio with video, or other sounds such as "white noise" while resting. People place headphones over their ears or place earbuds into their ears while leaning forward in a seated position or while lying down. Many headphones that cover the user's ears or earbuds inserted into the ear are not comfortable when the user's head is against a pillow or against the user's arm or another object. Pressure from an object against the headphones or earbuds, even from a relatively soft object such as a pillow, can cause discomfort to the user.

There is a need to design a comfortable pillow structure that allows the user to rest facing down towards a pillow structure, while the user's arms and/or hands are comfortably placed underneath the user's head at an angle substantially perpendicular to the user's body as this would allow the user to rest comfortably and position their arms in a manner that allowed flexibility in the user's movements and allow the user to perform sedentary activities. There is also a need to design a pillow structure that allows a user to read or use a mobile device while laying face down on the pillow. Lastly, there is a need to design a pillow structure that would accommodate wires, power cords, or headphones or earbuds as well a providing a source of light for reading or using a mobile device while laying face down on the pillow.

SUMMARY

The disclosure is directed to an expandable and collapsible pillow structure for a user to rest facing down toward the pillow structure. The pillow structure is designed to be used on an elevated surface such as a table, desk, or airplane tray table. The user is usually in a seated position when using the pillow structure. The pillow structure has a top surface, at least one side surface, a base, and an internal cavity in the pillow structure. The top surface is generally hemispherical in shape and forms a top pillow portion. The at least one side surface is generally frustoconical in shape and forms a pedestal pillow portion. The top pillow portion sits on top of the pedestal pillow portion. The base is generally where the pillow structure contacts the elevated surface. In one embodiment, the base can be generally rounded and/or generally flat. In another embodiment, the base can be the lower or bottom edge of the pedestal pillow portion, i.e., the side opposite of where the top pillow portion sits. In another embodiment, the base can be attached to the lower or bottom edge of the pedestal pillow portion. The pillow structure has at least three openings, of which at least one extends though the top surface of the top pillow portion and at least two extend through the side surface of the pedestal pillow portion. The at least two side openings are on opposing sides and extend inward from the outer edge of the side surface forming a bored out or tunnel shaped passage through the pedestal pillow portion. The bored out passage can dimensioned to receive the arms of a user through each opposing arm opening. The internal cavity provides fluid communication between each opening, that is, the internal cavity is accessible from the face opening and the arm openings. The pedestal pillow portion and the top pillow portion can be in an expanded configuration, or in a collapsed configuration. When in an expanded configuration the bored out passage for the arms is can structurally bear one or more applied loads received by the at least one face opening without being substantially deformed, thereby relieving pressure loading internal to the bored out arm receiver caused by the one or more applied loads when the pillow is in use.

In one embodiment, the face opening has a rim for the user's face to lean into the pillow structure for support. In another embodiment, the face opening also has a cut out at the lower edge. The cut out can provide additional support for the chin or provide additional air flow near the mouth. In another embodiment, the face opening is substantially circular. In another embodiment, the face opening is at an angle.

In one embodiment, the above described pillow structure has an additional opening on the side surface. The additional opening also communicates with the internal cavity. In another embodiment, the additional opening provides extra air flow to the internal cavity. In another embodiment, the additional opening can be sized to receive an externally positioned power supply cable or headphone wire into the internal cavity.

In one embodiment, the bored out arm passage can dimensioned to hold both arms and hands. In another embodiment, the bored out arm passage can dimensioned to allow extra room around both arms and hands.

In one embodiment, the above described pillow structure can expanded or collapsed by adding or removing air or gas. In another embodiment, at least one valve can be used to control the addition or the removal of air or gas. In another embodiment, a pump can be used to facilitate the addition or the removal of air or gas. In another embodiment, the pump is separate from the pillow structure such as a hand held bike pump or small foot pump. In another embodiment, the pump can be integrated into the pillow structure. In another embodiment, a carbon dioxide cartridge can be used to inflate the pillow structure. In another embodiment, the pump can have an automatic shut off valve that turns the pump off after a certain amount of time or once a certain air pressure is reached.

In one embodiment, the above described pillow structure can be made from a material that is puncture resistant and capable of being hermetically sealed. In another embodiment, the material can also be flexible to fold or roll up when in a collapsed state yet rigid enough to maintain form when in an expanded state. In another embodiment, the material can have multiple textures or different textures from one side to the other, either left to right or front to back. In another embodiment, two or more different materials can be used to make the above described pillow structure. For example a softer material can be used to make the face opening to increase user comfort. Alternatively, a soft surface cover or coating can be used to make the face opening. Non-limiting examples of materials that can be used to make the above described pillow structure include plastics, canvass, polymers, films, vinyl, polyvinyl chloride, urethane, rubber, treated fabrics, memory foam or beaded foam, down, feathers, or other pillow or foam materials, cotton, fleece, animal skin, polyester, felt, synthetic fabrics, etc.

In one embodiment, the above described pillow structure can also include a locking mechanism. The locking mechanism provides additional support when the pillow is in use.

In one embodiment, the above described pillow structure can also include a carrying and/or storage case. The shape and size of the case will depend on the shape and size of the collapsed pillow structure. The carrying case can also include a device for attaching the case to another object such as a clip or carabineer.

DESCRIPTION

The disclosure is directed to an expandable and collapsible pillow structure (herein referred to as pillow structure). In one embodiment, the pillow structure is designed to be used on an elevated surface such as a desk or table top. In another embodiment, the pillow structure is designed to be used on a fold down tray table such as those on the back of an airplane seat. In another embodiment, the pillow structure is designed to be used when the user is seated near an elevated surface. In another embodiment, the pillow structure is designed to be used by a person traveling. In a non-limiting embodiment, the pillow structure is designed to be compressed or collapsed into a smaller size for ease of carrying or packing. In one embodiment, the pillow structure is inflatable and deflatable.

Disclosed hereinafter and shown in accompanying FIGS. 1 to 16 are non-limiting embodiments of an expandable/collapsible pillow structure that further includes the capability of assuming two configurations: a first expanded or inflated configuration with non-limiting embodiments shown in FIGS. 1, 3, 11, 14, 15, 16, and 17 and a second collapsed, compressed or deflated configuration with non-limiting embodiments shown in FIGS. 2, 8, 9, and 13. The second configuration, i.e. collapsed/deflated configuration, provides a compact, easily portable package. The first configuration may be referred to as an "expanded" or "inflated" or "user ready" pillow structure and the terms are used interchangeably throughout the specification. The second configuration may be referred to as a "collapsed" or "compressed" or "deflated" or "stored" or "packed" pillow structure and the terms are used interchangeably throughout the specification. When the terms "one," "a," or "an" are used in this disclosure, they mean "at least one" or "one or more," unless otherwise indicated In some embodiments the first configuration can be deflated and compressed to form the second configuration, and the second configuration can be inflated and expanded to form the first configuration. In other embodiments expansion may be accomplished without manually or automatically inflating with air. Likewise, in other embodiments compression may be accomplished without manually or automatically deflating.

Figure 1:
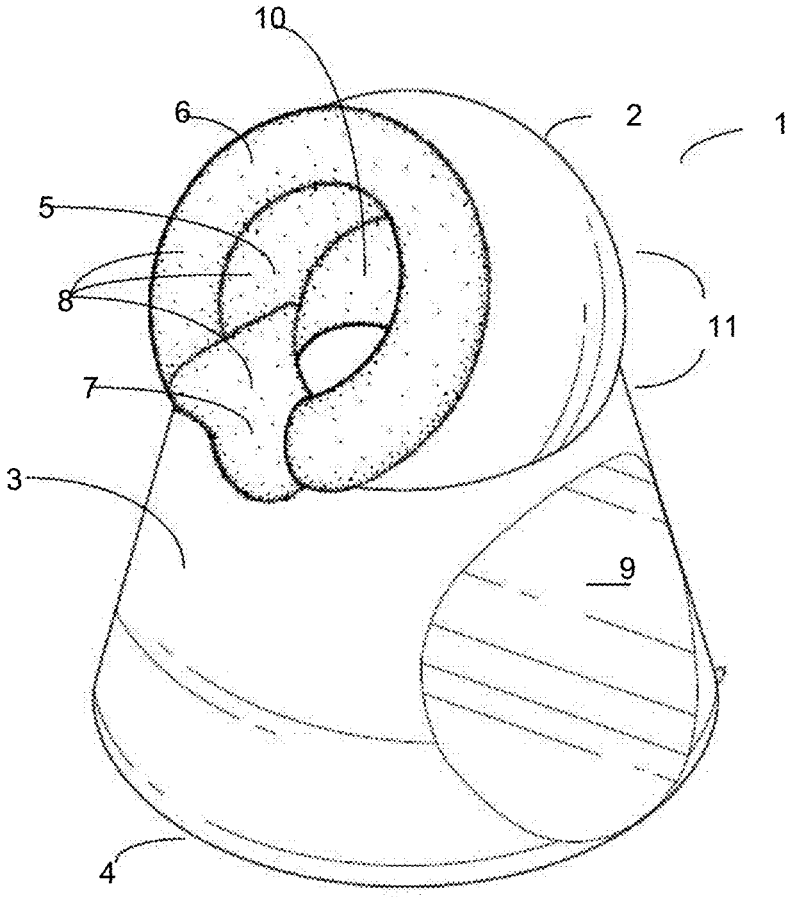
FIG. 1 is a perspective view of a non-limiting embodiment of an expandable/collapsible pillow structure in an inflated or expanded configuration.

FIG. 1 illustrates a perspective view of a non-limiting embodiment of the pillow structure in the first configuration. In this configuration, pillow structure 1 is in its expanded form, suitable for use as a pillow in a situation where a user is seated near a raised surface such as coach seating on an airplane. In one embodiment, the general shape of the pillow structure in this configuration is similar to the pillow described in U.S. Pat. No. 9,131,792, entitled "Pillow Structure", the entire contents of which are hereby incorporated by reference in t heir entirety.

Continuing to refer to FIG. 1, in this embodiment, the pillow structure 1 has a top surface 2, at least one side surface 3, and a base 4. In this embodiment, the top surface 2 is roughly hemispherical in shape and bounds a "top" or "top pillow" portion. The top surface has at least one opening 5, which may be referred to as a "top opening" or "face opening". The top opening extends inward into the top pillow portion. The top opening 5 has a rim 6 and a cut out 7. The face opening 5, rim 6, cut out 7 may be jointly referred to as the "rim portion" 8 of the pillow structure. The rim portion is designed to provide a comfortable resting place for the user's face. Rim 6 supports the user's face and can be any width or shape. In one embodiment, the rim 6 can be rounded and is about an inch or two wide. In another embodiment, the rim can extend into the top opening. Cut out 7 provides additional support for the user's face or chin to rest when the user's face is place in the top opening 5. Cut out 7 can also provides additional air circulation and flow near the user's mouth when the user's face is placed in the top opening 5. In another embodiment, the top opening is roughly circular in shape with cut out 7 located in the lower portion. The top opening can be placed anywhere on the top surface. In one embodiment, the top opening is at angled at a slight and gradual incline. In another embodiment, the top opening is substantially at the top of the pillow structure but not necessarily at the apex of the pillow structure. In another embodiment, the angle of the top opening is between 10 and 80 degrees when compared to a horizontal axis. In another embodiment, the angle of the top opening is between 20 and 70 degrees when compared to a horizontal axis. In another embodiment, the angle of the top opening is between 30 and 50 degrees when compared to a horizontal axis. In another embodiment, the angle of the top opening is about 35 to 45 degrees when compared to a horizontal axis.

Continuing to refer to FIG. 1, in this embodiment, the side surface 3 is rounded without delineated edges and roughly bounds a frustoconical or cylindrical in shape which serves as a "pedestal" or "pedestal pillow" portion or "lower" or "lower pillow" portion. The pedestal pillow portion supports the top pillow portion. Side surface 3 has at least two openings 9 (only one visible), which may be referred to as a "side opening" or "arm opening". Two of the at least two openings are on opposing sides of the side surface, extending inward from the sides. In one embodiment, two of the at least two openings 9 form a "tunnel" that passed through the pedestal pillow portion. In another embodiment, the tunnel is large enough to provide adequate room for a user's arms and hands to be placed inside. In another embodiment, side surface 3 has at least three openings.

Continuing to refer to FIG. 1, in this embodiment, base 4 is the pedestal pillow portion opposite the top pillow portion. In general, base 4 is the portion of the pillow structure that contacts the elevated surface upon which the pillow sits. In one embodiment, the base can be roughly circular in shape. In one embodiment the base can be disk shaped (see FIG. 1). In another embodiment, the base can be ring shaped, e.g. the lower edge of the pedestal pillow portion (see for example, FIG. 17). In another embodiment, the base is the lower or contact edge of the pedestal pillow portion. In one embodiment the base 4 is wide enough to maintain stability when the pillow structure is in use. In another embodiment, the diameter of the base 4 is smaller than the vertical height of the pillow structure. In another embodiment, the pillow is substantially taller than its horizontal length or width.

Continuing to refer to FIG. 1, the pillow structure 1 in its first configuration (i.e. expanded), has an internal cavity 10. The internal cavity is formed from the joining of the at least one top opening 2 and at least two side openings 9. In one embodiment, the at least two side openings are large enough to insert an object into the internal cavity such as a mobile device, phone, table, gaming device or other device. The at least two side openings can also provide space for a power cord or wire for headphones. In another embodiment, the cavity is formed from the joining of the at least one top opening and at least three side openings. In this embodiment, the third side opening can be used to pass cords to electronic devices placed inside of the internal cavity. Alternatively, in this embodiment, the third side opening can be use to illuminate the internal cavity or increase air circulation or flow into the cavity.

In one embodiment, the entire pillow structure can be made from one material. In another embodiment, the pillow structure can be made from at least two different materials. In another embodiment, the pedestal portion bounded by side surface 3 and base 4 and the hemispherical portion bounded by top surface 2 can be composed of a first material, whereas rim 6, cut-out region 7, optionally face opening 5 (which, in one embodiment, corresponds to the thickness dimension of rim 6), and optionally side opening 9 can be made of a second material. In another embodiment, side surface 3 and top surface 2 can be composed of a first material, rim 6, cut-out portion 7, optionally face opening 5, and optionally side opening 9 can be composed of a second material, and base 4 can be composed of a third material.

In one embodiment, various materials can be used to make the described pillow structure. In another embodiment, the material can be a material that is puncture resistant and capable of being hermetically sealed (i.e. holding air or gas). In another embodiment, the material can be flexible enough to fold or roll up when in a collapsed state yet rigid enough to maintain form when in an expanded state. In another embodiment, the material can have multiple textures or different textures from one side to the other, either left to right or front to back. In another embodiment, the material can be a material that is capable of expansion and collapsing. Non-limiting examples of materials include plastics, canvass, polymers, films, vinyl, polyvinyl chloride, urethane, rubber, treated fabric, memory foam or beaded foam, down, feathers, or other pillow or foam materials, materials having a soft surface (e.g. cotton, fleece, animal skin, polyester, etc.), multi-layer materials, etc.

In another embodiment (not shown), a separate removable cover can be used. The separate removable cover can help keep the pillow cleaner. The separate removable cover can help reduce the wear and tear on the pillow structure. The separate removable cover can be made from any material that is comfortable against a user's skin. The separate removable cover can be made from a cleanable or washable material. In general, the separate removable cover is designed to maintain the face opening of the pillow structure when it is on the pillow structure. In one embodiment, the separate removable cover covers a portion of the top pillow portion, mainly the top opening. In another embodiment, the separate removable cover covers the entire top pillow portion. In another embodiment, the separate removable cover covers the entire top pillow portion and a portion of the pedestal pillow portion. In another embodiment, the separate removable cover covers the entire pillow structure. In this embodiment, the removable cover includes openings that align with the side openings in the pedestal pillow portion. The separate removable cover can be held in place using a variety of mechanisms. Non-limiting mechanisms include elastic, ties, hook and loop (e.g. Velcro® brand), frog closures, magnets, buttons, etc.).

In one embodiment, pillow structure 1 can be inflatable/deflatable. In the inflatable/deflatable embodiment, pillow structure 1 can have portions that are inflatable/deflatable and portions that are not inflatable/deflatable. In one embodiment, the non-inflatable/deflatable portions can include the rim 6, cut-out 7, and optionally face opening 5. In another embodiment, the inflatable/deflatable portions of pillow structure 1 can include the top hemispherical portion and the pedestal portion, together referred to as the "inflatable portion" 11 of the pillow structure. In another embodiment, the inflatable/deflatable top hemispherical and pedestal portion are joined such that air can move from the top into the pedestal or vice versa. In another embodiment, the inflatable/deflatable top and pedestal portions are separate and air cannot move from the top into the pedestal or vice versa. In this embodiment, the user can adjust the firmness of the top portion separately from the firmness of the pedestal portion. For example, the top portion can be softer than the pedestal portion or vice versa.

In the inflatable/deflatable embodiments of the pillow structure, the inflatable/deflatable portions of the pillow structure (e.g. top surface 2, side surface 3, optionally rim portion 8, and optionally base 4) comprise multi-layer surfaces. The multi-layer surfaces have an interior region between the layers that is closed or sealed off from the exterior, and can accept and contain gas such as air pumped or blown there into. When the gas or air is pumped into the interior, the pedestal and hemispherical regions inflate and expand to assume the form of the first configuration. In one embodiment, the multi-layer surfaces include at least two layers. In another embodiment, the multi-layer surfaces include at least three layers. In another embodiment, the interior regions further include baffles or other structures that help control the air flow and/or restrict air movement.

Figure 2:
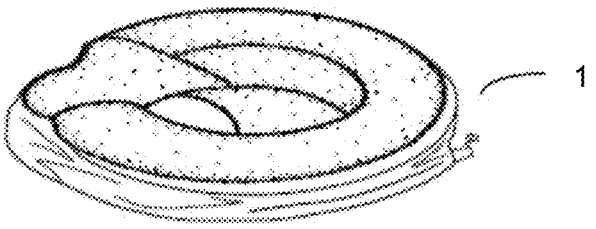
FIG. 2 is a perspective view of a non-limiting embodiment of an expandable/collapsible pillow structure in a fully compressed or deflated configuration.

FIG. 2 illustrates a perspective view of a non-limiting embodiment of the second configuration (i.e. compressed/deflated) of the pillow structure. In this configuration, pillow structure 1 is in its largely compressed form, suitable for convenient carrying and transport.

Figure 3:
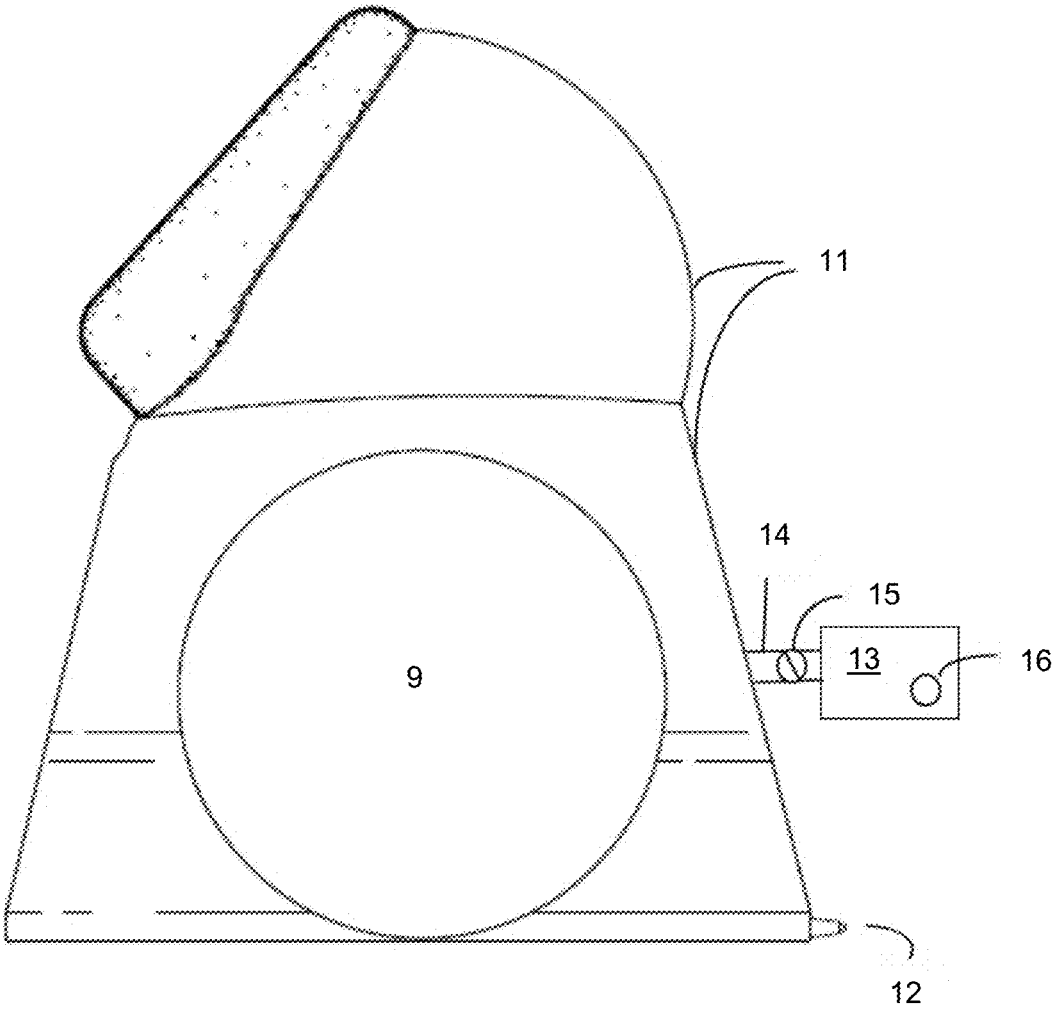
FIG. 3 is a side view of a non-limiting embodiment of an expandable/collapsible pillow structure in in an inflated or expanded configuration.

FIG. 3 is a side view of a non-limiting embodiment of the first configuration of the pillow structure, i.e., in its fully inflated form. Visible in this view is valve 12 in its closed off position. When the pillow structure is in its inflated configuration, the valve is closed off to prevent leakage of air out of the pillow. Feature 13 is an optional pump which may be integrated into the pillow structure. Having such an integrated pump would obviate the need to either blow up the pillow structure manually (e.g. by blowing into valve 12), or to attach an outside pump such as a bellows or bicycle pump or other pump means available in the market. Integrated pump 13 could be positioned either external to (as shown in the drawing) or internal to inflatable/deflatable portion 11 of the pillow structure. No matter where the pump itself was positioned, its output would have to be pumped into the interior of inflatable portion 11, to inflate the pillow structure. In one embodiment, air would be pumped into the interior of inflatable/deflatable portion 11 via pump inlet 14, which may also include a shut-off 15 which would prevent leakage when the pump was off. Also shown is start button 16, which could be pressed to initiate an automated inflation process. Such an integrated pump mechanism in one embodiment would be battery powered. In another embodiment, the integrated pump further includes a pressure sensor. In another embodiment, the integrated pump further includes an automatic shut off. The automatic shut off can be activated based on the amount of time the pump runs or can be tied to a pressure sensor.

Figure 4:
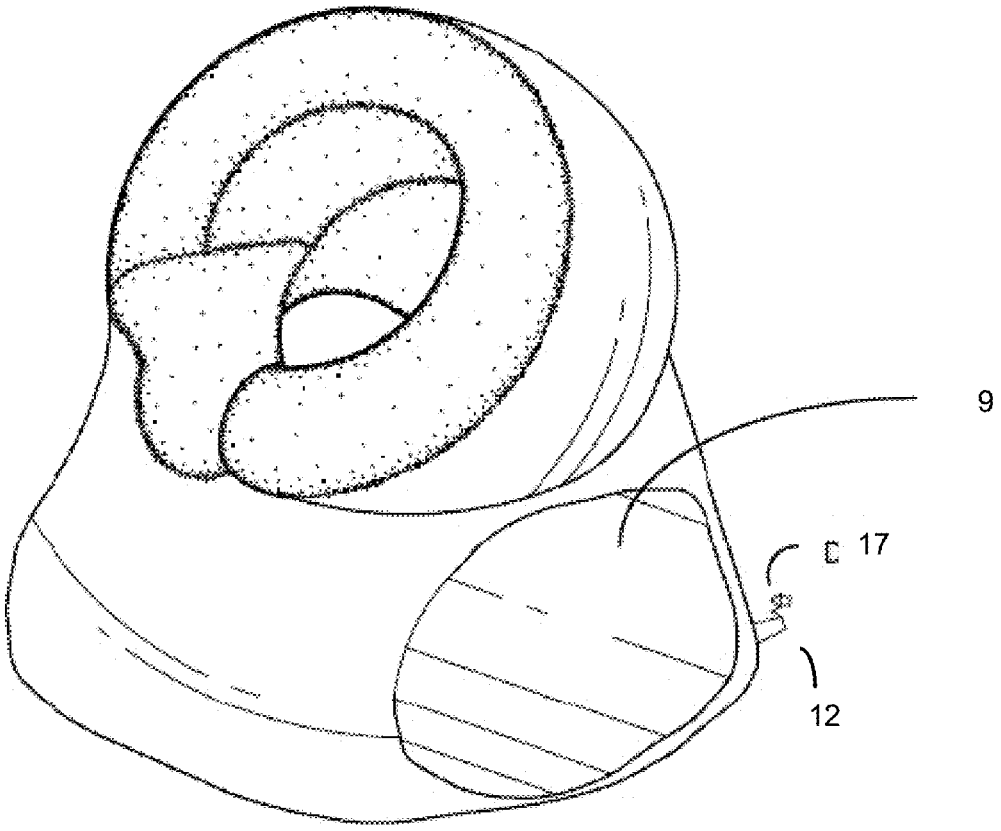
FIG. 4 is a perspective view of a non-limiting embodiment of an expandable/collapsible pillow structure during initial stages of compression or deflation of the pillow structure.

FIG. 4 is a perspective view during initial stages of deflation of a non-limiting embodiment of the inflatable/deflatable pillow structure. To deflate, valve 12 is opened (which may be accomplished by pulling out valve stopper 17), allowing air to escape from the inflatable portion. FIG. 4 also shows the arm opening 9 collapsing downward, and the vertical height of the pedestal portion decreasing as deflation occurs.

Figure 5:
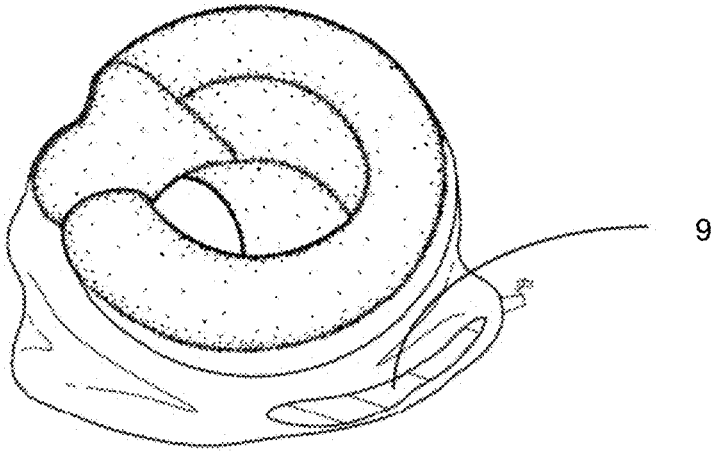
FIG. 5 is a perspective view of a non-limiting embodiment of an expandable/collapsible pillow structure in a later stage of compression or deflation of the pillow structure.
Figure 6:
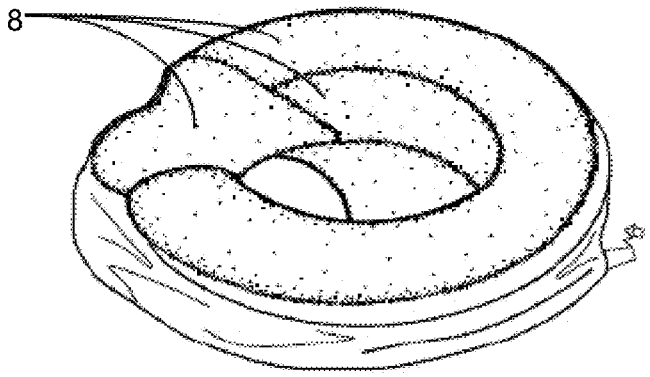
FIG. 6 is a perspective view of a non-limiting embodiment of an expandable/collapsible pillow structure in a later stage of compression or deflation of the pillow structure.

FIGS. 5 and 6 show sequentially later stages of deflation of a non-limiting embodiment of the inflatable/deflatable seated pillow structure. Arm opening 9 collapses completely, the pedestal portion also collapses vertically, until rim portion 8 lies essentially horizontally atop collapsed inflatable/deflatable portion 11.

As the remaining air is let out from the mostly deflated stage shown in FIG. 6, the pillow structure assumes the fully deflated form of the second configuration, shown in FIG. 2.

Figure 7:
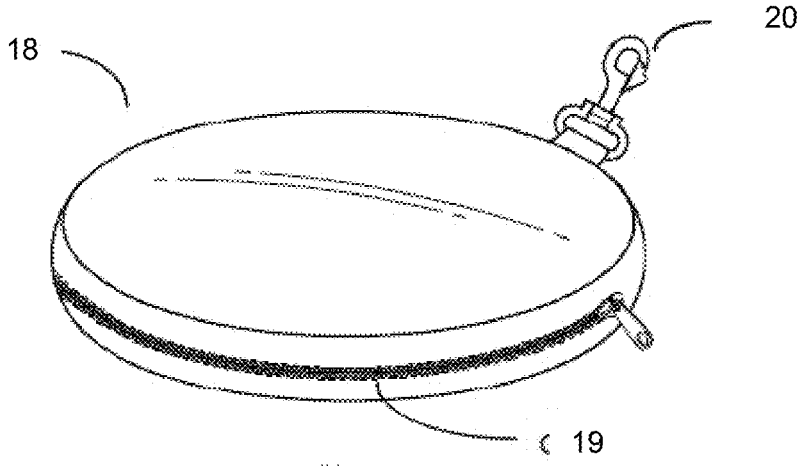
FIG. 7 is a perspective view of a non-limiting embodiment of a carrying case configured to hold and transport the compressed or deflated pillow structure shown in FIG. 2.

FIG. 7 illustrates a non-limiting example of a carrying case 18 configured to hold and transport the deflated pillow structure shown in FIG. 2. Closing mechanism 19 allows easy packing. Non-limiting examples of closing mechanisms include zippers (illustrated), hook and loop (e.g. Velcro® closures), and snaps. Attachment mechanism 20 enables attaching carrying case 18 to a suitcase, luggage rack, or belt by way of example. Non-limiting examples of attachment mechanisms include clips, carabiners, hook and loop (e.g. Velcro closures), and buckles.

Figure 8:
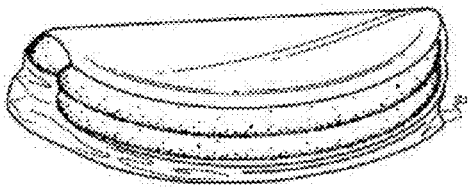
FIG. 8 is a perspective view of a non-limiting embodiment of a compressed or deflated pillow structure folded in half to yield a half-circular shape.
Figure 9:
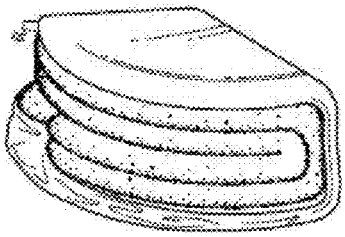
FIG. 9 is a perspective view of a non-limiting embodiment of a compressed or deflated pillow structure folded in quarters to yield a quarter-circular shape.
Figure 10:
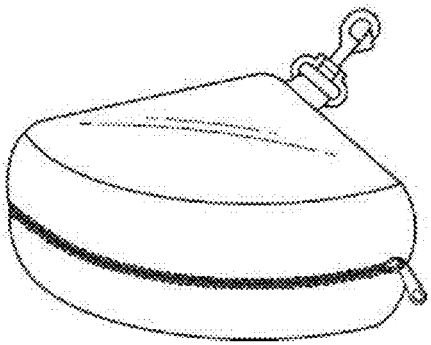
FIG. 10 is a perspective view of a non-limiting embodiment of a carrying case.

FIGS. 8 and 9 illustrate further compaction of the deflated pillow structure shown in FIG. 2. FIG. 8 shows folding the deflated pillow structure once in half to yield a half-circular shape, and FIG. 9 shows folding the deflated pillow structure two times in half to yield a quarter-circular shape. FIG. 10 shows a non-limiting example of a quarter-circular carrying case, thick enough to accept the twice folded deflated pillow structure.

Figure 11:
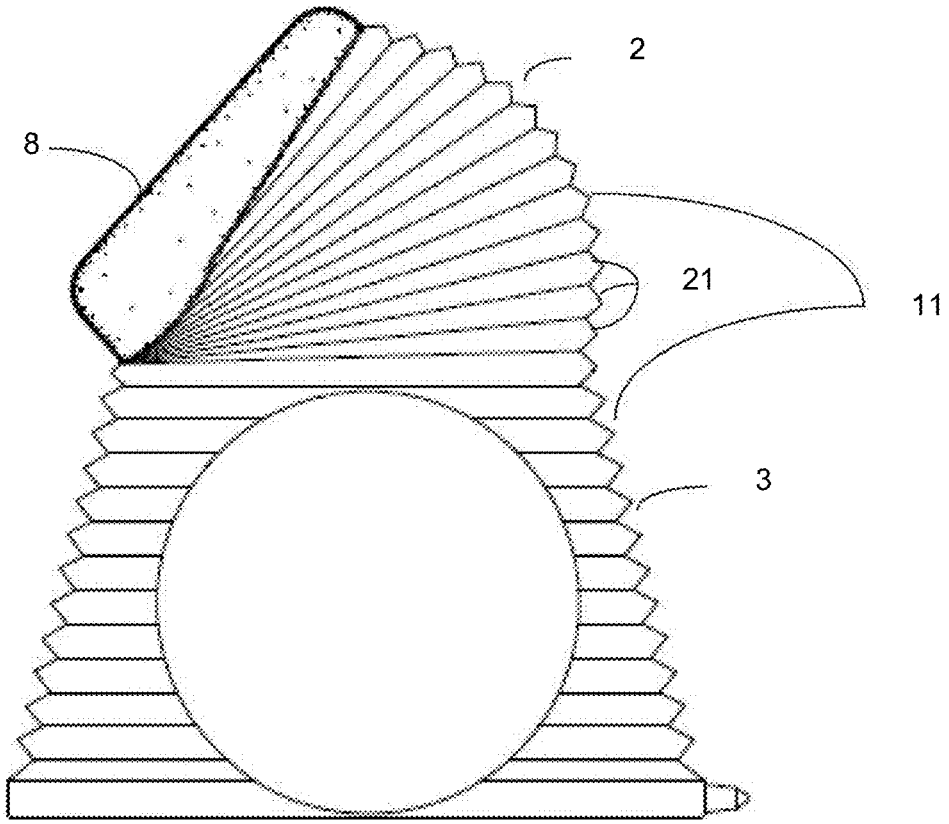
FIG. 11 is a side view of a non-limiting embodiment of an expandable/collapsible pillow structure.

FIG. 11 illustrates a side view of another non-limiting embodiment of the expandable/collapsible pillow structure, in its first, i.e., fully expanded, configuration. In this embodiment, top surface 2 and side surface 3 are constructed of a plurality of accordion folds 21, for the purpose of enabling a predetermined accordion-like deflated configuration, rather than a simple collapse during deflation, as demonstrated in an earlier embodiment. The number of accordion folds can vary; in the figure, there are numerous such folds, both on the top surface 2 of the hemispherical portion, and on the side surface 3 of the pedestal portion. However, in other embodiments, there may be a much smaller number of accordion folds.

Other than the difference in the top surface and side surface between the accordion folds in this embodiment and absence thereof in an earlier embodiment, the two embodiments of the expandable/collapsible pillow structure share the same features as discussed in detail in paragraphs 40 through 49 above and briefly discussed below.

As in the earlier embodiment of the expandable/collapsible pillow structure, the pedestal portion of this embodiment, bounded by side surface 3 and the hemispherical portion bounded by top surface 2, are composed of a first material, whereas the rim, face opening (which corresponds to the thickness dimension of the rim), and cut-out region, are made of a second material. The pedestal portion and the hemispherical portion are connected and inflatable. This implies that those portions of the pillow structure have an interior region between the exterior walls (i.e., the sides) that is closed or sealed off from the exterior, and can accept gas such as air pumped or blown there into. The interior of the pedestal portion and the hemispherical portion communicate with one another, i.e. are connected and form one combined interior. When the gas or air is pumped into the interior, the pedestal and hemispherical regions inflate and expand to assume the form of the first configuration. The inflatable/deflatable pedestal and hemispherical portions this embodiment of the expandable/collapsible pillow structure are together referred to as the inflatable portion 11. An optional pump (not shown) can be integrated into this embodiment similarly to the way it can be integrated into the earlier embodiment shown in FIG. 3.

The rim, face opening (not shown), and cut-out regions (not shown) are together referred to as the rim portion 8. The rim portion is designed to provide a comfortable resting place for the user's face, and in some embodiments is not made to be inflatable. The rim portion may be comprised of a soft comfortable material such as memory foam or beaded foam or down or feathers or other pillow or foam materials, and may have a soft surface covering such as cotton, fleece, animal skin, polyester, by way of example.

Figure 12:
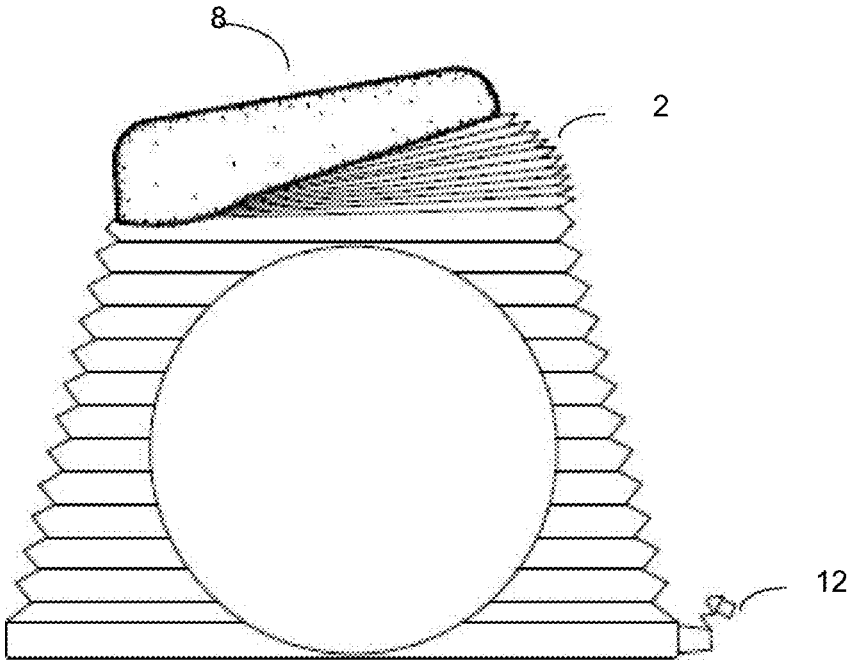
FIG. 12 is a side view of a non-limiting embodiment of an expandable/collapsible pillow structure during initial stages of compression or deflation of the pillow structure.

FIG. 12 is a side view during initial stages of deflation of the non-limiting embodiment shown in FIG. 11. To deflate, valve 12 is opened, allowing deflation to take place. In an embodiment of the partially deflated stage, in the first step, rim portion 8 is tilted to a more horizontal position, compressing the accordion folds of top surface 2, thereby deflating the hemispherical portion.

Figure 13:
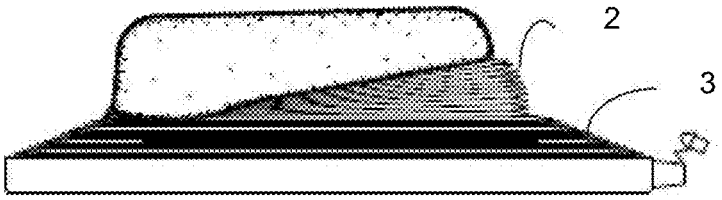
FIG. 13 is a perspective view of a non-limiting embodiment of an expandable/collapsible pillow structure in a fully compressed or deflated configuration.

FIG. 13 is a side view of the non-limiting embodiment shown in FIG. 11 in its second configuration, i.e. fully deflated stage. Following the full compression of the accordion folds of top surface 2, the accordion folds of side surface 3 are compressed, thereby deflating the pedestal portion and yielding the fully compressed and deflated configuration shown in the figure. In one embodiment, having the accordion folds yields a neat and compact second configuration.

Figure 14:
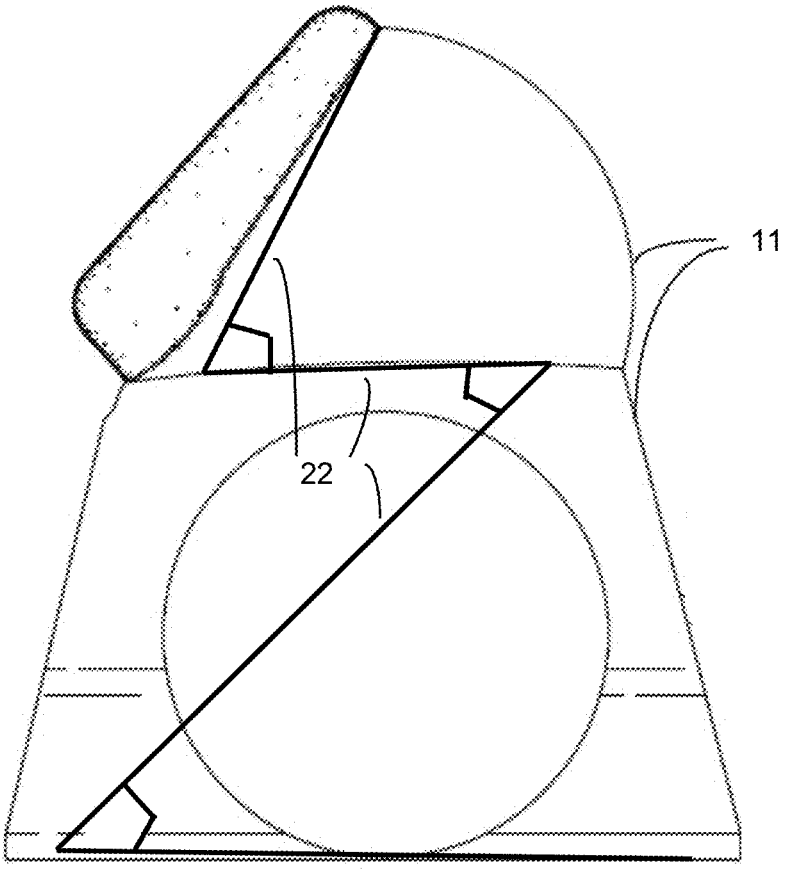
FIG. 14 is a side view of a non-limiting embodiment of an expanded pillow structure with the locking mechanism locking it open.

FIG. 14 is a side view of an expanded configuration of another non-limiting embodiment of the expandable/collapsible pillow structure incorporating a locking mechanism. This embodiment may include inflatability, or alternately it may be expandable and compressible without inflation or deflation. In this embodiment, a locking mechanism 22 engages to maintain the pillow structure in its expanded configuration. The locking mechanism can take many forms, non-limiting examples include a latch that pops into place when the expansion is complete or a locking hinge. If the structure is expanded, such a locking mechanism could provide robustness to keep the structure in its fully expanded configuration, whether or not inflated. Additionally, the locking mechanism could enable a purely mechanical expansion in place of inflation. The pillow structure could be opened and then locked into its opened, expanded position.

Figure 15:
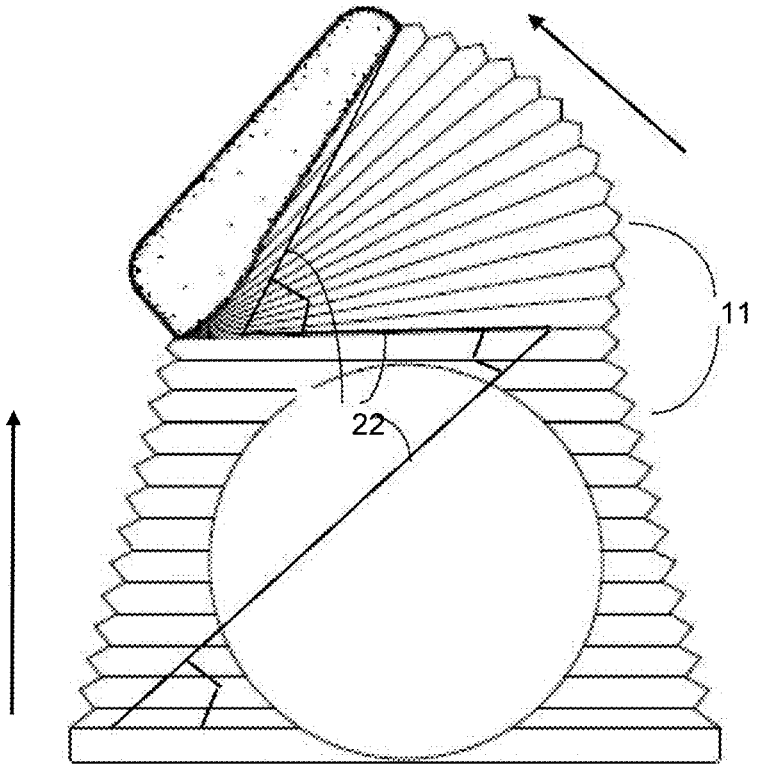
FIG. 15 is a side view of a non-limiting embodiment of an expanded pillow structure with the locking mechanism locking it open.

FIG. 15 is a side view of an expanded configuration of another non-limiting embodiment with both accordion folds and a locking mechanism. FIG. 15 also shows the accordion folds adapted to being manually unfolded (in the directions of the arrows on the figure), such that the pedestal portion and hemispherical portion, which together are referred to as the expandable portion 11, open and cause portion 11 to expand. Locking mechanism 22 is then engaged to hold the pillow structure in its open, expanded configuration. The locking mechanism 22 can then be disengaged to allow the pillow structure to close into the compressed configuration. The locking mechanism can take various forms. Non-limiting mechanical locking mechanisms include those similar to those on folding chairs or tables may be used, a hinged mechanism (shown on the figure), those similar to children's expandable plastic cups, wherein the rings click into an open configuration as the top ring is lifted and others. In some embodiments, an air inlet into the interior of the expandable portion can be included to account for the volume will increase as the structure is expanded.

Figure 16:
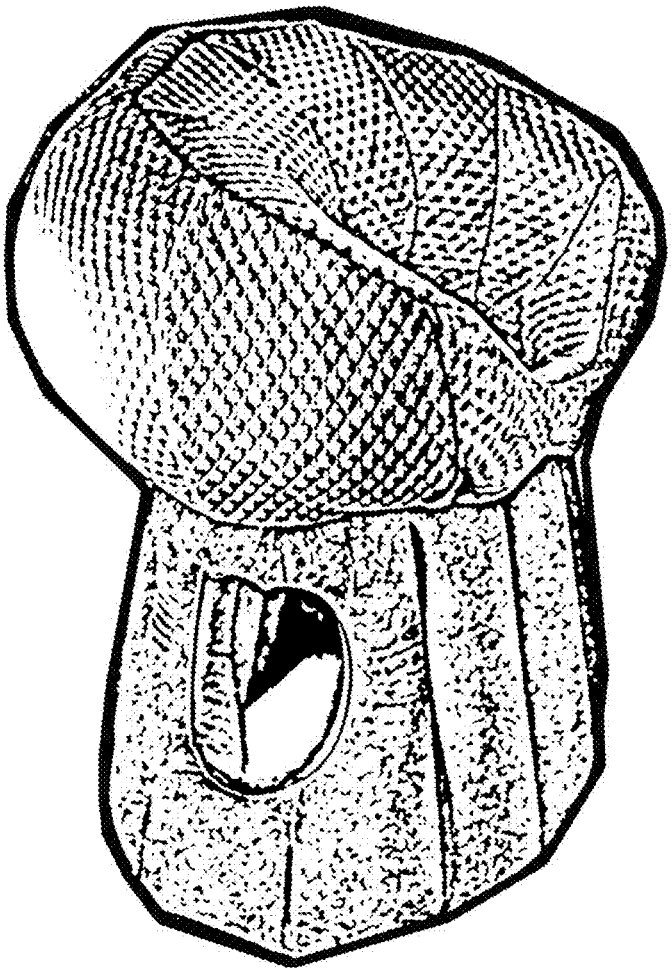
FIG. 16 is a perspective view of a non-limiting embodiment of an expanded/collapsible pillow structure in an inflated or expanded configuration.

FIG. 16 is a perspective view of a non-limiting embodiment of the expandable/collapsible pillow structure. In this embodiment, the face opening has a much larger rim and the base is the ring shaped lower portion of the pedestal pillow.

Figure 17:
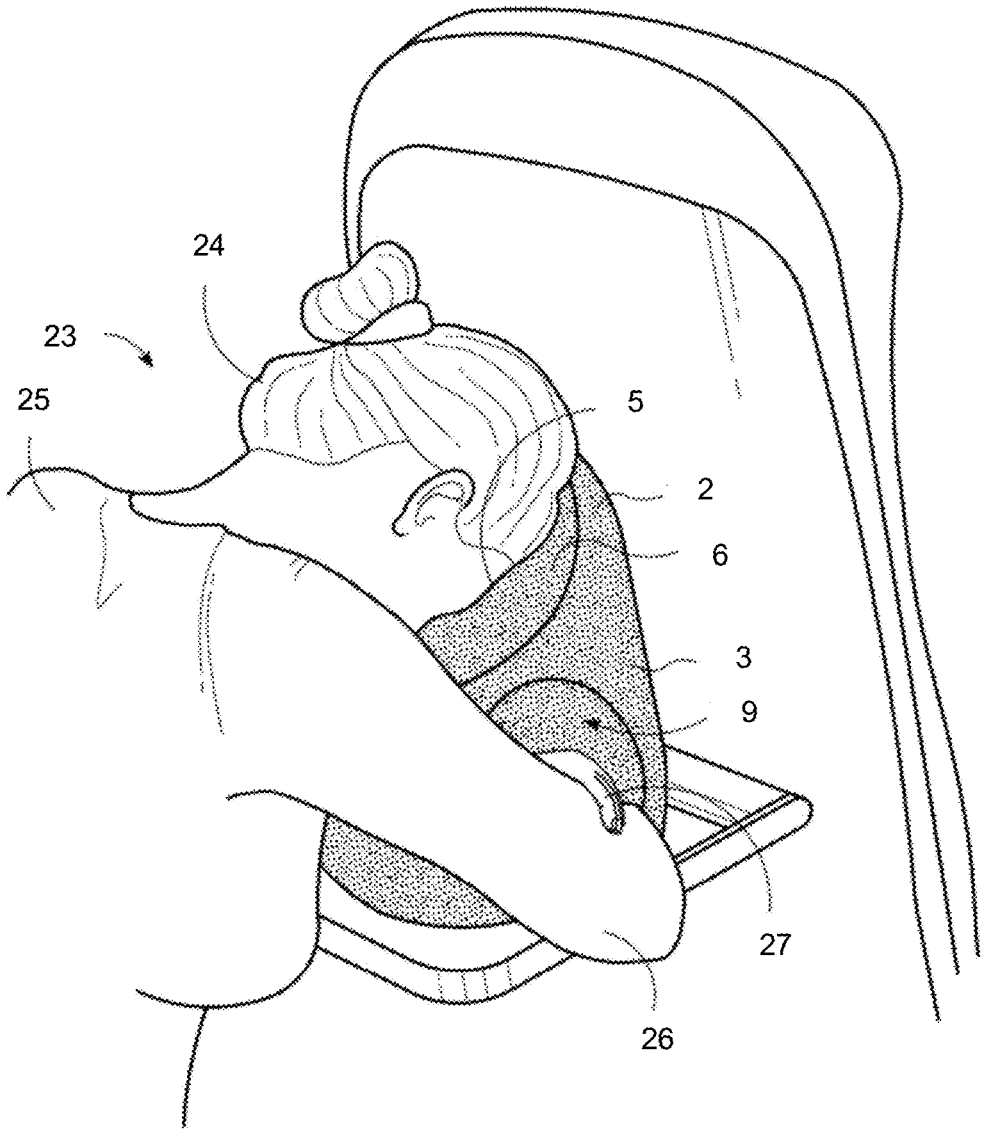
FIG. 17 is a perspective view of a non-limiting embodiment of an expanded pillow structure in use by a person.

FIG. 17 is a perspective view of a non-limiting embodiment of a user using the expandable/collapsible pillow structure. In this embodiment, the pillow structure is being used on the surface of a pull down tray located on the back of an airline seat. The pillow is shaped such that the user 23 is in a comfortable position that reduces strain on the neck, shoulders, arms, hands, and waist/hips. The user's head position 24 is higher than the body 25. The higher head position allows the use to place her arms 26 and hands 27 in the tunnel like side openings. The user leans forward into the pillow structure, placing her face into the top opening 5 without leaning too far at the waist or hips. The placement of the arms into the side openings leaves allows the arms to remain substantially perpendicular to the user's body 25. In another embodiment, the user can place her arms around the pedestal pillow portion instead of placing the hands and arms in the side openings.

In another embodiment (not shown), the user can lay the side of her head on a section of the top pillow that does not have a top opening. In this embodiment, it may be more comfortable for the user to only place one arm and hand though the side openings.

In one inflatable/deflatable embodiment, the weight of the user's head on the top pillow portion increases the air pressure in the pedestal pillow portion. The increased air pressure in the pedestal pillow portion provides additional structural support ensuring that the at least two side openings do not deform or collapse. Keeping pressure off the arms allows for proper blood circulation and reduces or prevents the arms from "falling asleep" due to lack of blood circulation. The use of a locking device can also help prevent the side openings from deforming or collapsing.

While the disclosure has been illustrated and described in detail in the foregoing description, such description is to be considered illustrative or exemplary and not restrictive. The disclosure is not limited to the disclosed embodiments. Modifications to the disclosed embodiments can be understood and effected by those skilled in the art in practicing the claimed disclosure, from a study of the disclosure and the appended claims. For example, other materials can be used to manufacture the pillow structure other than those listed.

The invention claimed is:

1. An expandable and collapsible pillow structure comprising:

a top surface;

at least two sides;

a bottom surface;

a height;

a width;

a depth;

at least three openings, including:

at least one top opening through the top surface of the pillow structure, the top opening configured such that the user's face can be supported against edges of the top opening, and wherein the top opening is at an angle to the bottom surface;

at least two side openings extending from an outer edge of the at least two sides of the pillow structure, said at least two side openings configured to insert the user's arms there through when using the pillow structure; and a cavity in an internal region of the pillow structure, wherein the cavity can be accessed from the at least one top opening and the at least two side openings; and a valve;

wherein the height of the pillow is between one and two times the width of the pillow;

wherein the width of the pillow is about the same as the depth of the pillow; and wherein the pillow can be in an expanded configuration or in a collapsed configuration.

2. The pillow structure of claim 1, wherein the at least one top opening is substantially circular.

3. The pillow structure of claim 1, wherein the top opening further comprises a rim for the user's face to lean into the pillow structure for support.

4. The pillow structure of claim 1, wherein the at least two side openings are on substantially opposite sides of the pillow structure.

5. The pillow structure of claim 1, wherein the at least two side openings are substantially non-circular in shape.

6. The pillow structure of claim 1, further comprising a fourth opening.

7. The pillow structure of claim 6, wherein the fourth opening is a third side opening.

8. The pillow structure of claim 7, wherein the fourth opening is equidistant from the two side openings.

9. The pillow structure of claim 1, wherein the expanded configuration and the collapsed configuration are achieved through an addition or a removal of air or gas.

10. The pillow structure of claim 1, further comprising at least one pump to facilitate the addition or the removal of air or gas.

11. The pillow structure of claim 1, wherein the pillow structure is made from at least one material.

12. The pillow structure of claim 11, wherein the at least one material is puncture resistant.

13. The pillow structure of claim 11, wherein the at least one material is capable of being hermetically sealed.

14. The pillow structure of claim 11, wherein the at least one material is flexible enough to fold or roll up when in the collapsed configuration.

15. The pillow structure of claim 1, where in the pillow structure is made from at least two different materials.

16. The pillow structure of claim 15, wherein the at least two different materials are both puncture resistant.

17. The pillow structure of claim 15, wherein the at least two different materials are both capable of being hermetically sealed.

18. The pillow structure of claim 15, wherein the at least two different materials are both flexible enough to fold or roll up when in the collapsed configuration.

19. The pillow structure of claim 1, further comprising a separate removable cover.

20. The pillow structure of claim 1, further comprising a carrying and/or storage case.

* * * * *